US005948325A

United States Patent [19]

Yanaka

[11] Patent Number: 5,948,325

[45] Date of Patent: Sep. 7, 1999

[54] AIR-FUEL RATIO ADJUSTMENT DEVICE FOR CARBURETOR

[75] Inventor: Yuzuru Yanaka, Iwate-Gun, Japan

[73] Assignee: U.S.A. Zama, Inc., Franklin, Tenn.

[21] Appl. No.: 08/874,335

[22] Filed: Jun. 13, 1997

Related U.S. Application Data

[63] Continuation-in-part of application No. 08/661,309, Jun. 13, 1996, abandoned.

[51] Int. Cl.[6] ..... F02M 7/10

[52] U.S. Cl. ..... 261/71; 251/903; 261/DIG. 38; 261/DIG. 84

[58] Field of Search ..... 261/41.5, 71, 40, 261/DIG. 38, DIG. 84, 41.4; 251/900, 903

[56] References Cited

U.S. PATENT DOCUMENTS

| | | | |
|---|---|---|---|
| 1,536,630 | 5/1925 | Reinecke | 251/903 X |
| 1,833,983 | 12/1931 | Werder | 251/903 X |
| 2,583,291 | 1/1952 | Beem | 251/900 X |
| 2,666,614 | 1/1954 | Grove et al. | 251/900 X |
| 3,167,599 | 1/1965 | Brown et al. | 261/41.5 |
| 3,469,825 | 9/1969 | Du Bois | 261/DIG. 38 |
| 3,554,500 | 1/1971 | Hideg | 261/41.5 |
| 3,997,141 | 12/1976 | Baumann | 251/903 X |
| 4,283,353 | 8/1981 | Miller | 261/DIG. 38 |
| 4,336,208 | 6/1982 | Gerhardy | 261/DIG. 38 |
| 4,392,633 | 7/1983 | Van Winkle | 251/903 X |
| 4,601,310 | 7/1986 | Phillips | 251/903 X |
| 5,201,491 | 4/1993 | Domangue | 251/903 X |

FOREIGN PATENT DOCUMENTS 1-28220 6/1989 Japan .

*Primary Examiner*—Richard L. Chiesa
*Attorney, Agent, or Firm*—Lyon & Lyon LLP

[57] ABSTRACT

A fastening member made of an elastic material is press-fitted in a gapless manner in an insertion hole that divides screw holes in a carburetor body into forward and rearward sections. Screw rods of adjustment valves are screwed into the screw holes and through screw through-holes formed in the fastening member. The screw through-holes have female screw-threads formed by thread rolling. The female screw-threads maintain pressing contact with the surfaces of male screw-threads on the screw rods as a result of the elastic recovery force of the female screw-threads, so that rattling and fuel leakage tend to be prevented.

18 Claims, 2 Drawing Sheets

AIR-FUEL RATIO ADJUSTMENT DEVICE FOR CARBURETOR

This application is a continuation-in-part of U.S. patent application Ser. No. 08/661,309, filed Jun. 13, 1996, now abandoned, the disclosure of which is incorporated herein by reference.

FIELD OF THE INVENTION

This invention relates to carburetors and, more particularly, to an air-fuel ratio adjustment device equipped with manual adjustment valves that control the flow rate of fuel or bleed air inside a carburetor to adjust the air-fuel ratio of an air-fuel mixture supplied to an engine.

BACKGROUND OF THE INVENTION

When the air-fuel mixture supplied to an engine is adjusted by means of a carburetor, as with an automobile engine, the air-fuel ratio is adjusted by controlling the idle fuel flow rate, and also, in some cases, by controlling the bleed air flow rate. However, in carburetors used for all-purpose engines, the air-fuel ratio is adjusted by controlling the flow rates of both the main fuel and the low-speed fuel.

In order to enable such adjustments to be performed manually by manufacturers of carburetors, engines, or machines and vehicles in which carburetor-equipped engines are mounted, manual adjustment valves are included in the design of some carburetors. Such adjustment valves typically comprise a head part and a needle-shaped valve body. The head part protrudes to the outside of the carburetor main body and is used to rotate a screw rod which is screwed into the main body of the carburetor and which moves back and forth when it is rotated. The needle-shaped valve body is attached to the screw rod, and inserted into a fuel passage or bleed air passage to vary the effective area of the passage in a continuous manner.

The adjustment valve and the main body of the carburetor are both made of metal. As a result of the machining tolerance, a gap is formed between the female screw-threads in the screw hole of the carburetor main body, and the male screw-threads on the screw rod of the adjustment valve. In an attempt to prevent rattling of the adjustment valve due to the gap, a compression coil spring is installed around the screw rod between the carburetor main body and the head part.

When conventional means such as a compression coil spring are used to fasten the adjustment valve in place, the compression coil spring tends to throw the flow rate out of adjustment. This is because the compression coil spring draws the adjustment valve back by a distance equal to the aforementioned gap after the adjustment valve has been screwed into a desired position, and a screwdriver engaged with the head part is removed. The effect on the air-fuel ratio is especially great in small carburetors which are used for all-purpose engines, because the passage diameters are extremely small in such carburetors. Furthermore, because the system is designed to prevent rotation of the adjustment valve by contact friction between the compression coil spring and the head part, it is necessary to use a fairly long spring and to press the spring against the head part with a strong force to achieve an adequate rotation-checking friction. As a result, the screw rod and head part protrude a considerable distance to the outside of the main body of the carburetor. With long protruding head parts, a large rotational moment is thus generated due to vibrations of the engine, machine, or vehicle involved, causing the adjustment valve to rotate and throw the air-fuel ratio further out of adjustment. Moreover, when the carburetor is enclosed in a housing and attached to an all-purpose engine, a large housing must be provided to accommodate the long protruding head parts.

A countermeasure to unwanted rotation of the adjustment valves has been disclosed in Japanese Patent Application Kokoku No. Hei 1-28220. The disclosed arrangement includes a threadless hole formed in a retaining plate made of a synthetic resin which is an elastic material. The screw rod is passed through the threadless hole, cutting screw threads in the hole as it passes through the hole. The screw rod is then screwed into the screw hole formed in the main body of the carburetor. Thus, rotation of the adjustment valve is prevented by a plate-shaped tightening member instead of by a compression coil spring.

In the rotation-checking means described in Kokoku No. Hei 1-28220, a square tightening member is inserted into a thin square recess formed in the main body of the carburetor and cut across the screw hole. The tightening member has projections on both the front and back surfaces, and on all its outside edges. The tightening member is fastened inside the recess by the pressing contact of the projections with the inside facing surfaces and inside edge surfaces, on three sides, of the recess.

More particularly, the projections on both surfaces of the tightening member act to hold the tightening member substantially perpendicular to the axial line of the adjustment valve, while the projections on the outside edges act to hold the tightening member so that the tightening member cannot rotate. However, equipment such as a special mold, etc., is required to form such a tightening member with projections, complicating the manufacture of the tightening member.

In addition, because the screw rod of the adjustment valve cuts screw threads as it passes through the hole of the tightening member, the elastic force of the synthetic resin material of the tightening member cannot act sufficiently on the screw rod. As a result, the adjustment valve tends not to be fastened in a strong and stable manner.

Thus, even where a plate-shaped tightening member is used instead of a compression coil spring as a means of checking the rotation of the adjustment valve, and also as a countermeasure to the adjustment valve drawback problem and the need to lengthen the adjustment valve's protruding head portion, problems remain because it is difficult to mold the plate-shaped tightening member, and the member is not very reliable as a rotation-checking member.

SUMMARY OF THE INVENTION

The present invention is directed to an improved air-fuel ratio adjustment device having a tightening member that is easy to manufacture and tends to exhibit a high level of reliability as a rotation-checking member.

An exemplary embodiment of an air-fuel ratio adjustment device of the present invention comprises an adjustment valve having a screw rod and a needle-shaped valve body. The screw rod is screwed into a screw hole formed in the main body of the carburetor. The air-fuel ratio is adjusted by inserting the valve body at the tip of the screw rod into a fuel passage or air passage of the carburetor to adjust the effective area of said passage.

An insertion hole is formed in the main body of the carburetor and cuts across the screw hole. A fastening member made of an elastic material is press-fitted into the insertion hole so that there are no gaps, at least in the area where said insertion hole cuts across the screw hole. The fastening member has a screw through-hole that is coaxial with the screw hole in the main body of the carburetor. Female screw-threads are formed in the screw through-hole by thread rolling. The screw rod of the adjustment valve is passed through the screw through-hole of the fastening member so that the male screw-threads on the screw rod are engaged with the female screw-threads in the screw through-hole.

The formation of screw threads by thread rolling is a screw working process which creates no cutting debris. The fastening member is placed in a compressed state as a result of being press-fit into the insertion hole. The female screw-threads formed in the fastening member undergo elastic deformation during the screw working process, thus following the screw working process, the female screw-threads return to their pre-working state as a result of their own elastic force. The male screw-threads on the screw rod engage the female screw-threads in the screw through-hole, and the screw rod pushes the female screw-threads apart while passing through the fastening member. The female screw-threads adhere tightly to the male screw-threads due to their own elastic recovery force. As a result, the insertion hole and fastening member can be formed from simple shapes, and the adjustment valve can be firmly and stably fastened in place.

Accordingly, it is an object of the present invention to provide an improved air-fuel ratio adjustment device for a carburetor.

A further object of the present invention is to provide a method for fastening adjustment valves (used for air-fuel ratio adjustment) firmly and stably in place so the air-fuel ratio can be properly adjusted.

Further objects and advantages of the present invention will become apparent from a consideration of the drawings and the following description.

DESCRIPTION OF THE PREFERRED EMBODIMENT

Figure 1:
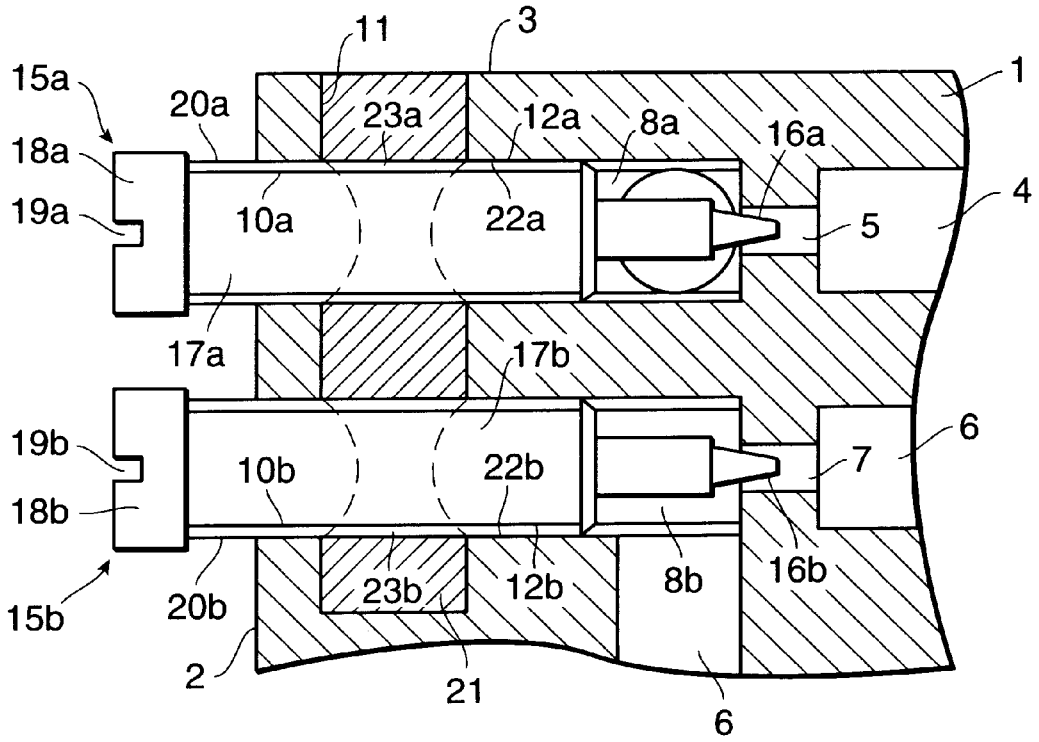
FIG. 1 is a partial longitudinal sectional view illustrating a preferred embodiment of the present invention.

Referring to FIG. 1, an air-fuel ratio adjustment device according to a preferred embodiment of the present invention is shown as applied to a carburetor used for all-purpose engines. The carburetor as shown is equipped with two manual adjustment valves 15*a* and 15*b* for adjusting the main fuel flow rate and the low-speed fuel flow rate respectively.

The manual adjustment valves 15*a* and 15*b* adjust the effective areas of a main fuel passage 4 and a low-speed fuel passage 6 respectively. The main fuel passage 4 and the low-speed fuel passage 6 extend from a diaphragm type or float type constant-fuel chamber (not shown) to a main nozzle and an idle port or a slow port opening into an air intake passage (not shown). The two adjustment valves 15*a* and 15*b* are installed preferably parallel and in close proximity to each other.

The adjustment valves 15*a* and 15*b* are equipped with needle-shaped valve bodies 16*a* and 16*b* respectively, screw rods 17*a* and 17*b* respectively, and head parts 18*a* and 18*b* respectively. The needle-shaped valve bodies 16*a* and 16*b* are inserted into jets 5 and 7 respectively, which are formed in fuel passages 4 and 6 respectively, and which independently vary the effective areas of jets 5 and 7 respectively. The screw rods 17*a* and 17*b* are screwed into respective screw holes 8*a* and 8*b* formed parallel to each other and coaxial with jets 5 and 7. The screw rods 17*a* and 17*b* extend from an outside surface 2 of the carburetor main body 1 to the respective fuel passages 4 and 6. The head parts 18*a* and 18*b* protrude to the outside of the carburetor main body 1 and have tool grooves 19*a* and 19*b* respectively, which are adapted to receive the engaging end of a screwdriver.

A cylindrical insertion hole 11 is formed in the main body 1 of the carburetor. The insertion hole 11 extends inward from an outside surface 3 of the main body 1 which is perpendicular to the outside surface 2. The insertion hole 11 cuts across the two screw holes 8*a* and 8*b* at positions that divide the screw holes 8*a* and 8*b* into forward and rearward sections. The insertion hole 11 is larger in diameter than the screw holes 8*a* and 8*b,* and is perpendicular to the axial centers of the screw holes 8*a* and 8*b*.

A cylindrical fastening member 21 is press-fitted into the insertion hole 11 so there are no gaps left anywhere in the insertion hole 11. The cylindrical fastening member 21 is preferably made of an elastic material, such as a synthetic resin or synthetic rubber, with a high elastic force. The fastening member 21 has screw through-holes 22*a* and 22*b* which are coaxial with the screw holes 8*a* and 8*b* respectively. The screw rods 17*a* and 17*b* pass through the fastening member 21 so that male screw-threads 20*a* and 20*b* engage with female screw-threads 23*a* and 23*b* of the screw through-holes 22*a* and 22*b,* as well as with female screw-threads 10*a* and 12*a,* and 10*b* and 12*b,* of the screw holes 8*a* and 8*b,* respectively.

In the present invention, the female screw-threads 23*a* and 23*b* of the screw through-holes 22*a* and 22*b* formed in the fastening member 21 are formed by thread rolling. The fastening member 21 is press-fitted into the insertion hole 11 so that there are no gaps. Accordingly, the female screw-threads 23*a* and 23*b* adhere firmly to the male screw-threads 20*a* and 20*b,* fastening the adjustment valves 15*a* and 15*b* in place in a position that divides the screw holes 8*a* and 8*b* into forward and rearward sections.

Figure 2A:
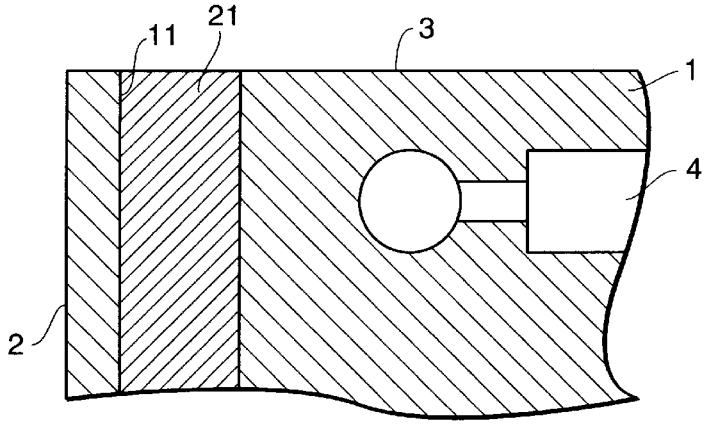
FIGS. 2A–2C show a series of partial longitudinal sectional views illustrating the steps of an exemplary process used to form the preferred embodiment shown in FIG. 1.
Figure 2B:
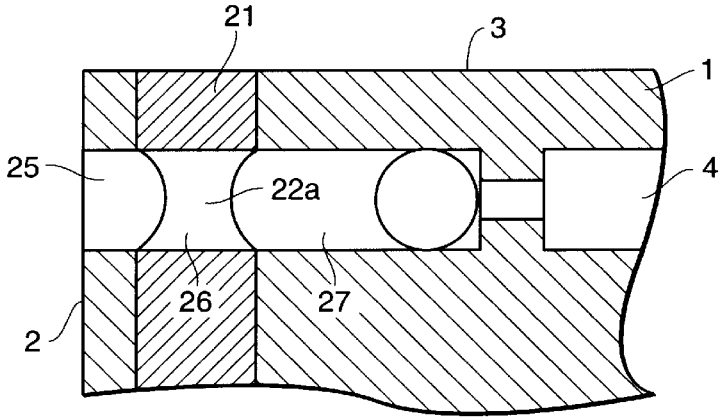
Figure 2C:
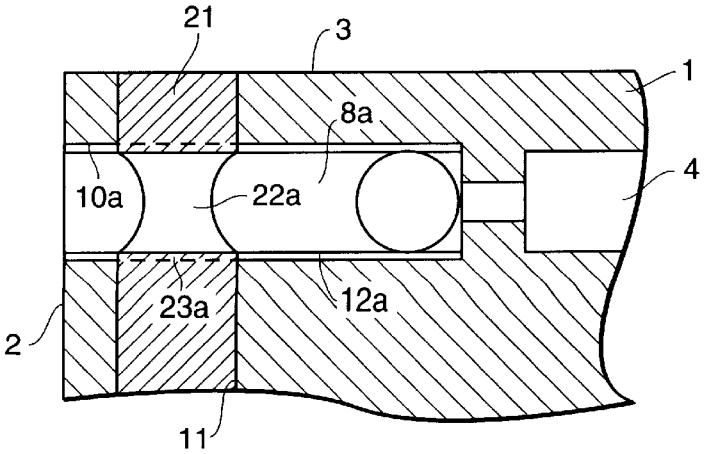

FIGS. 2A–2C illustrate the preferred steps in an exemplary process used to form the screw holes 8*a* and 8*b* and screw through-holes 22*a* and 22*b* as shown in FIG. 1. Although FIGS. 2A–2C only show the formation of one screw hole 8*a* and one screw through-hole 22*a,* it will be understood by one skilled in the art that a second screw hole 8*b* and a second screw through-hole 22*b* can be formed by a similar process.

First, the insertion hole 11 is formed by cutting from the outside surface 3. The fastening member 21 which has approximately the same length as the insertion hole 11 and which is larger in diameter than the insertion hole 11 is then press-fitted into the insertion hole 11 (FIG. 2A).

Next, preliminary holes 25, 26, and 27 for screw hole 8*a* and screw through-hole 22*a* are successively formed by cutting from the outside surface 2 (FIG. 2B). Preliminary holes 25, 26, and 27 are formed with a diameter approximately equal to the effective diameter of the male-threaded screw rod 17*a* (FIG. 1) and the effective diameter of the female threaded screw hole 8*a* and screw through-hole 22*a*. Furthermore, as a result of the continuous formation of the preliminary holes 25, 26, and 27, screw hole 8*a* and screw through-hole 22*a* are formed coaxially with each other.

Turning now to FIG. 2C, when a thread rolling tap is caused to advance into the preliminary holes 25, 26, and 27, from outside surface 2, female screw-threads 10*a* are formed in preliminary hole 25, female screw-threads 23*a* are formed in preliminary hole 26, and female screw-threads 12*a* are formed in preliminary hole 27. The working process of thread rolling does not create any cutting debris. When the rolling tap is withdrawn, the female screw-threads 10*a* and 12*a* formed in the preliminary holes 25 and 27 of the carburetor main body 1, which is made of metal, have undergone plastic deformation and therefore retain their shape. However, because fastening member 21 is made of an elastic material, the female screw-threads 23*a* formed in the preliminary hole 26 of the fastening member 21 are elastically deformed and, therefore, return to their pre-working state as a result of their own elastic force (FIG. 2C).

Referring back to FIG. 1, when screw rods 17*a* and 17*b* are screwed into screw holes 8*a* and 8*b* and screw through-holes 22*a* and 22*b*, the male screw-threads 20*a* and 20*b* first engage with the female screw-threads 10*a* and 10*b* located in the vicinity of the outside surface 2 so that the adjustment valves 15*a* and 15*b* are positioned concentrically with the screw holes 8*a* and 8*b* and screw through-holes 22*a* and 22*b*. As the screw rods 17*a* and 17*b* are screwed in further, they pass smoothly through the screw through-holes 22*a* and 22*b* while the female screw-threads 23*a* and 23*b* engage the male screw-threads 20*a* and 20*b* on the screw rods 17*a* and 17*b*. The screw rods 17*a* and 17*b* then engage the female screw-threads 12*a* and 12*b* of the screw holes 8*a* and 8*b* respectively in the vicinity of the fuel passages 4 and 6. As a result, the screw rods 17*a* and 17*b* are screwed into and held in the desired adjustment positions.

When screw rods 17*a* and 17*b* are screwed in as described, a gap is formed between the female screw-threads 10*a*, 12*a* and 10*b*, 12*b* and the male screw-threads 20*a* and 20*b* where the screw rods 17*a* and 17*b* pass through screw holes 8*a* and 8*b*. However, where the screw rods 17*a* and 17*b* pass through the screw through-holes 22*a* and 22*b*, the female screw-threads 23*a* and 23*b* are again elastically deformed by the male screw-threads 20*a* and 20*b* to substantially the shape formed by the thread rolling taps. As a result, the female screw-threads 23*a* and 23*b* press firmly against the surfaces of the male screw-threads 20*a* and 20*b* due to the elastic recovery force of the material of the female screw-threads 23*a* and 23*b*. Accordingly, after the adjustment valves 15*a* and 15*b* are screwed into the desired positions, and a screwdriver used to adjust the adjustment valves 15*a* and 15*b* is removed, the adjustment valves 15*a* and 15*b* remain fastened in the desired positions and tend not to draw back from the desired positions. Furthermore, vibration of the engine, machine, or vehicle involved, is absorbed by the fastening member 21, and any inclination or rotation of the adjustment valves 15*a* and 15*b* is prevented by the pressing contact of the female screw-threads 23*a* and 23*b* against the male screw-threads 20*a* and 20*b* at a location where the screw rods 17*a* and 17*b* pass through the fastening member 21. Moreover, there is no need to cause the head parts 18*a* and 18*b* to protrude a great distance from the carburetor main body 1 for accommodating lengthy compression spring coils. Accordingly, the size of the housing used to accommodate the carburetor can be reduced.

In addition, in the preferred embodiment of the present invention as shown in the figures, the screw through-holes 22*a* and 22*b* envelop the screw rods 17*a* and 17*b* so that areas of gapless engagement are formed at intermediate points in the screw holes 8*a* and 8*b*. As a result, the leakage of fuel and air tends to be prevented so that adjustment of the air-fuel ratio can be more accurately performed.

It is not, however, necessary that the fastening member 21 be press-fitted in a gapless state throughout the entire insertion hole 11. It would also be possible to press-fit the fastening member 21 only in the areas where the insertion hole 11 cuts across the screw holes 8*a* and 8*b*. Moreover, the respective shapes of the insertion hole 11 and fastening member 21 are optional, because the insertion hole 11 is ordinarily formed by a mold during casting of the carburetor main body 1 or cut by drilling following the casting of the carburetor main body 1. Thus, a simple shape such as an angular prism or cylinder is ideal. Furthermore, because the fastening member 21 is press-fitted in a gapless manner in the insertion hole 11 which has such a simple shape, the fastening member 21 may also have a corresponding simple shape.

In addition, it is not necessary that the insertion hole 11 be formed so that the axial center of said insertion hole 11 intersects the axial centers of the screw holes 8*a* and 8*b*. The insertion hole 11 may also cut across the screw holes 8*a* and 8*b* in an offset position. Accordingly, the adjustment valves 15*a* and 15*b* can be stably fastened in accordance with an object of the present invention even if the screw rods 17*a* and 17*b* are not completely surrounded by the fastening member 21.

In the preferred embodiment of the present invention, as described above, adjustment valves can be firmly and stably fastened in place in desired adjustment positions by means of an extremely simple structure. As a result, the air-fuel ratio can be appropriately adjusted by accurately controlling the flow of air or fuel. Hence, the air-fuel ratio adjustment device of the present invention provides many benefits over the prior art.

While the above description contains many details, these shall not be construed as limitations on the scope of the invention, but rather as examples of particular embodiments thereof. Many other variations are possible and will be apparent to a person of ordinary skill in the art. Accordingly, the scope of the present invention shall not be determined by the embodiments described herein, but by the appended claims and their legal equivalents.

What is claimed is:

1. A carburetor comprising a body having a screw hole for an adjustment valve and an insertion hole extending through said body and across said screw hole, a fastening member disposed within said insertion hole, said fastening member including female thread members, and an adjustment valve member disposed within said screw hole, said valve member including male thread members adapted to engage and elastically deform said female thread members, said female thread members being adapted to exert a recovery force on said male thread members to stably retain said adjustment valve in said screw hole.

2. The carburetor of claim 1 wherein said fastening member includes a through hole formed therein substantially coaxial with said screw hole, said female thread members being formed in a wall of said through hole.

3. The carburetor of claim 1 wherein said fastening member is made of an elastic material.

4. The carburetor of claim 1 wherein said fastening member is press-fitted into said insertion hole.

5. The carburetor of claim 1 wherein said body further comprises a second screw hole and a second adjustment valve member disposed within said screw hole, said insertion hole extending across said second screw hole, said second adjustment valve member having second male thread members adapted to engage and elastically deform said female thread members, said female thread members being adapted to exert a recovery force on said second male thread members to stably retain said second adjustment valve in said second screw hole.

6. The carburetor of claim 5 wherein said fastening member comprises first and second through holes formed therein substantially coaxial with said screw hole and said second screw hole, said female threads being formed in first and second walls of said first and second through holes.

7. The carburetor of claim 1 wherein said female threads are formed by thread rolling.

8. A carburetor comprising a body including a screw hole for an adjustment valve having first female thread members and an insertion hole extending through said body and across said screw hole, an adjustment valve member disposed within said screw hole, said valve member including male thread members adapted to engage said female thread members of said screw hole, and a fastening member disposed within said insertion hole, at least a portion of said fastening member being elastically deformed to form second female thread members, said second female thread members being adapted to exert a recovery force on said male thread members to restrain said adjustment valve in said screw hole.

9. The carburetor of claim 8 wherein said second female thread members are formed by thread rolling.

10. The carburetor of claim 8 wherein said fastening member includes a through hole formed therein substantially coaxial with said screw hole, said second female thread members being formed in a wall of said through hole.

11. The carburetor of claim 8 wherein said fastening member is made of an elastic material.

12. The carburetor of claim 8 wherein said fastening member is press-fitted into said insertion hole.

13. The carburetor of claim 8 wherein said body further comprises a second screw hole having third female thread members and a second adjustment valve member including second male thread members adapted to engage said third female thread members, said insertion hole extending across said screw hole, said second female thread members being adapted to exert a recovery force on said second male thread members to restrain said second adjustment valve in said second screw hole.

14. The carburetor of claim 13 wherein said fastening member comprises first and second through holes formed therein substantially coaxial with said screw hole and said second screw hole, said second female thread members being formed in first and second walls of said first and second through holes.

15. A carburetor comprising a carburetor body having first and second screw holes and an insertion hole extending through said body and across said first and second screw holes, a fastening member disposed substantially within said insertion hole, said fastening member having first and second through-holes coaxial with said first and second screw holes, at least a portion of a wall of said first and second through-holes being elastically deformed to form first and second female thread members, a first adjustment valve disposed within said first screw hole in the carburetor body, said first adjustment valve comprising a head part at one end, a needle-shaped tip at the other end, and a screw rod attached therebetween; and a second adjustment valve disposed within a second screw hole in the carburetor body, said second adjustment valve comprising a head part at one end, a needle-shaped body at the other end, and a screw rod attached therebetween; said screw rod of said first and second adjustment valves having first and second male thread members adapted to engage and elastically deform said first and second female thread members, said first and second female thread members being adapted to exert a recovery force on said first and second male thread members to restrain said first and second adjustment valves in said first and second screw holes and prevent drawback of said first and second adjustment valves after adjustment.

16. The carburetor of claim 15 wherein said first and second female thread members are formed by thread rolling.

17. The carburetor of claim 15 wherein said fastening member is made of an elastic material.

18. The carburetor of claim 15 wherein said fastening member is press-fitted into said insertion hole.

* * * * *